US010559908B2

(12) United States Patent
Oka

(10) Patent No.: US 10,559,908 B2
(45) Date of Patent: Feb. 11, 2020

(54) CONNECTOR

(71) Applicant: Sumitomo Wiring Systems, Ltd., Yokkaichi, Mie (JP)

(72) Inventor: Kazumi Oka, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/273,412

(22) Filed: Feb. 12, 2019

(65) Prior Publication Data

US 2019/0273338 A1 Sep. 5, 2019

(51) Int. Cl.
*H01R 13/436* (2006.01)
*H01R 13/506* (2006.01)
*H01R 13/52* (2006.01)

(52) U.S. Cl.
CPC ..... *H01R 13/4367* (2013.01); *H01R 13/506* (2013.01); *H01R 13/5208* (2013.01)

(58) Field of Classification Search
CPC ..... H01R 13/4367
See application file for complete search history.

(56) References Cited

U.S. PATENT DOCUMENTS 9,099,796 B2 * 8/2015 Myer ..... H01R 13/113
9,431,723 B2 * 8/2016 Chikusa ..... H01R 4/48
9,515,396 B2 * 12/2016 Chikusa ..... H01R 13/113
9,570,854 B2 * 2/2017 Hashimoto ..... H01R 13/113
9,922,755 B2 * 3/2018 Matsui ..... H01R 31/08
2005/0227551 A1 * 10/2005 Tabata ..... H01R 13/113 439/852
2007/0099520 A1 * 5/2007 Anbo ..... H01R 4/185 439/852
2012/0258623 A1 10/2012 Nawa
2014/0051276 A1 * 2/2014 Itou ..... H01R 13/4223 439/271
2014/0051307 A1 * 2/2014 Aoki ..... H01R 13/432 439/746
2015/0263456 A1 * 9/2015 Hashimoto ..... H01R 13/113 439/752.5
2016/0006143 A1 * 1/2016 Chikusa ..... H01R 4/48 439/816
2016/0013569 A1 * 1/2016 Chikusa ..... H01R 13/113 439/816
2019/0237892 A1 * 8/2019 Hashimoto ..... H01R 13/113

FOREIGN PATENT DOCUMENTS

JP 2012-221785 11/2012

* cited by examiner

*Primary Examiner* — Ross N Gushi
(74) *Attorney, Agent, or Firm* — Gerald E. Hespos; Michael J. Porco; Matthew T. Hespos

(57) ABSTRACT

A terminal fitting (80) includes a projection (92) on an outer surface of a body (81). A housing (10) includes a cavity (11) into which the terminal fitting (80) is to be inserted, a guiding groove (23) into which the projection (92) enters, and an inverted insertion guiding groove (28) into which the projection (92) enters when the body (81) is in an inverted insertion posture. The housing (10) includes an inverted insertion guiding slope (32) formed on a groove surface of the inverted insertion guiding groove (28), inclined in a direction intersecting an inserting direction of the body portion (81) to face the projection (92) and configured such that the projection (92) slides on the inverted insertion guiding slope (32).

4 Claims, 12 Drawing Sheets

CONNECTOR

BACKGROUND

Field of the Invention

The invention relates to a connector.

Related Art

Japanese Unexamined Patent Publication No. 2012-221785 discloses a connector with a housing that has terminal accommodating chambers. A one-piece rubber plug is arranged in a rear part of the housing and a rear holder is arranged behind the one-piece rubber plug. The one-piece rubber plug includes sealing holes that communicate coaxially with the terminal accommodating chambers in a front-rear direction, and the rear holder includes through holes that communicate coaxially with the sealing holes.

The terminal fitting includes a wire crimping portion to be crimped to a wire in a rear part and a rectangular tube in a front part. The rectangular tube is inserted into the terminal accommodation chamber from the through hole through the sealing hole. A stabilizer projects on an outer surface of the rectangular tube.

The stabilizer enters a cut region formed by partially cutting an inner surface of the through hole when the rectangular tube is in a proper insertion posture with respect to the through hole. In this way, the insertion of the terminal fitting is allowed. On the other hand, the stabilizer contacts a peripheral part of the through hole at the rear surface of the rear holder when the rectangular tube is in a vertically inverted improper posture with respect to the through hole. Contact of the stabilizer with the rear surface of the rear holder in this way restricts the insertion of the terminal fitting.

If a projecting dimension of the stabilizer decreases, for example, with miniaturization of the connector, a sufficient contact margin of the stabilizer with the rear surface of the rear holder cannot be ensured when the rectangular tube is inverted. As a result, the stabilizer may be forced into the through hole while deforming the rear holder, and it may not be possible to stop the terminal fitting in an inverted inserting state.

The invention was completed on the basis of the above situation and aims to provide a connector capable of reliably detecting a terminal fitting in an inverted inserting state.

SUMMARY

The invention is directed to a connector with a terminal fitting including a terminal body and a projection on an outer surface of the terminal body. The connector also includes a connector body with a terminal insertion hole into which the terminal body is to be inserted. The connector body also has a guiding groove communicating with the terminal insertion hole and configured such that the projection enters the guiding groove. The connector body also includes an inverted insertion guiding groove communicating with the terminal insertion hole and configured such that the projection enters the inverted insertion guiding groove when the terminal body is in an inverted insertion posture. An inverted insertion guiding slope is formed on a surface of the inverted insertion guiding groove and is inclined in a direction intersecting an inserting direction of the terminal body to face the projection and is configured such that the projection slides on the inverted insertion guiding slope.

If the terminal body is inserted in the inverted insertion posture into the terminal insertion hole, the projection enters the inverted insertion guiding groove and slides on the facing inverted insertion guiding slope. Thus, the terminal body or a part connected to the terminal body (including the projection) contacts an inner surface of the terminal insertion hole or an inner surface of a part connected to the terminal insertion hole (including the inverted insertion guiding groove). Thus, the terminal fitting in an inverted inserting state can be stopped reliably.

The projection may be located at an intermediate position of the inverted insertion guiding slope when the terminal body is in the inverted insertion posture and the terminal fitting stops. According to this configuration, a selection range of a means for stopping the terminal fitting can be expanded and a degree of freedom in design can be enhanced as compared to the case where the projection contacts a back surface of the inverted insertion guiding groove to stop the terminal fitting in the inverted inserting state.

The terminal fitting may have a second projection on a surface of the terminal body, and the connector body may have a recess communicating with the terminal insertion hole and configured to receive the second projection. A contact stop may be on an inner surface of the recess and may stop the second projection when the terminal body is in the inverted insertion posture. The forms of the recess and the contact stop can be determined relatively freely. Thus, the terminal fitting in the inverted inserting state can be stopped more reliably.

DETAILED DESCRIPTION

Figure 7:
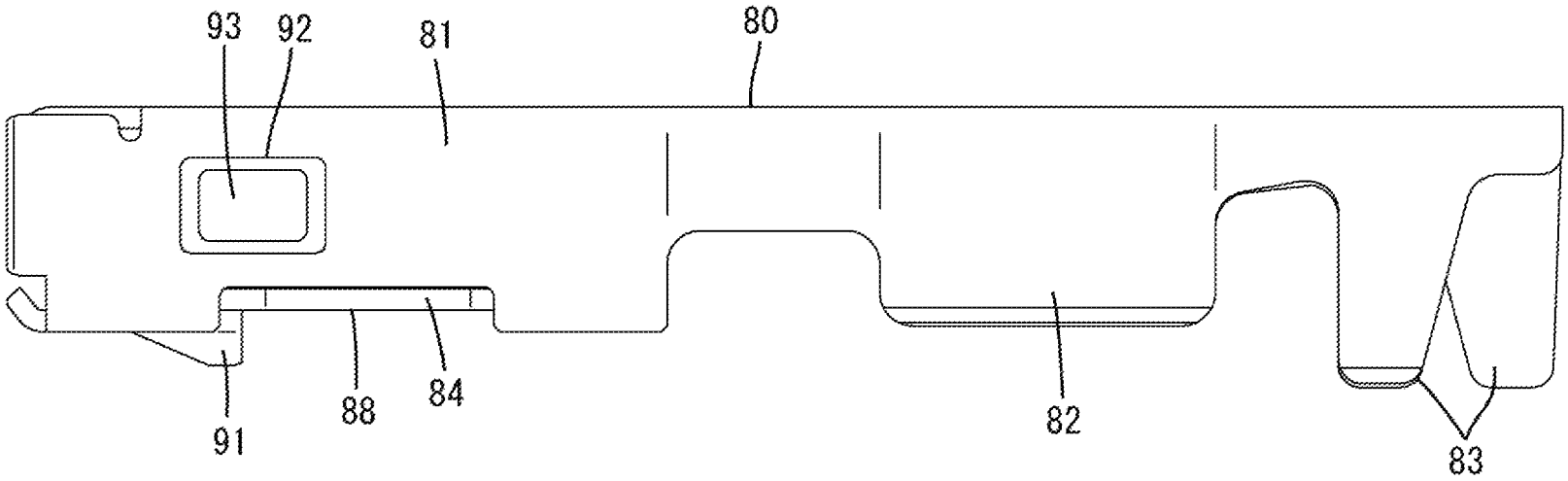
FIG. 7 is a side view of the terminal fitting.
Figure 8:
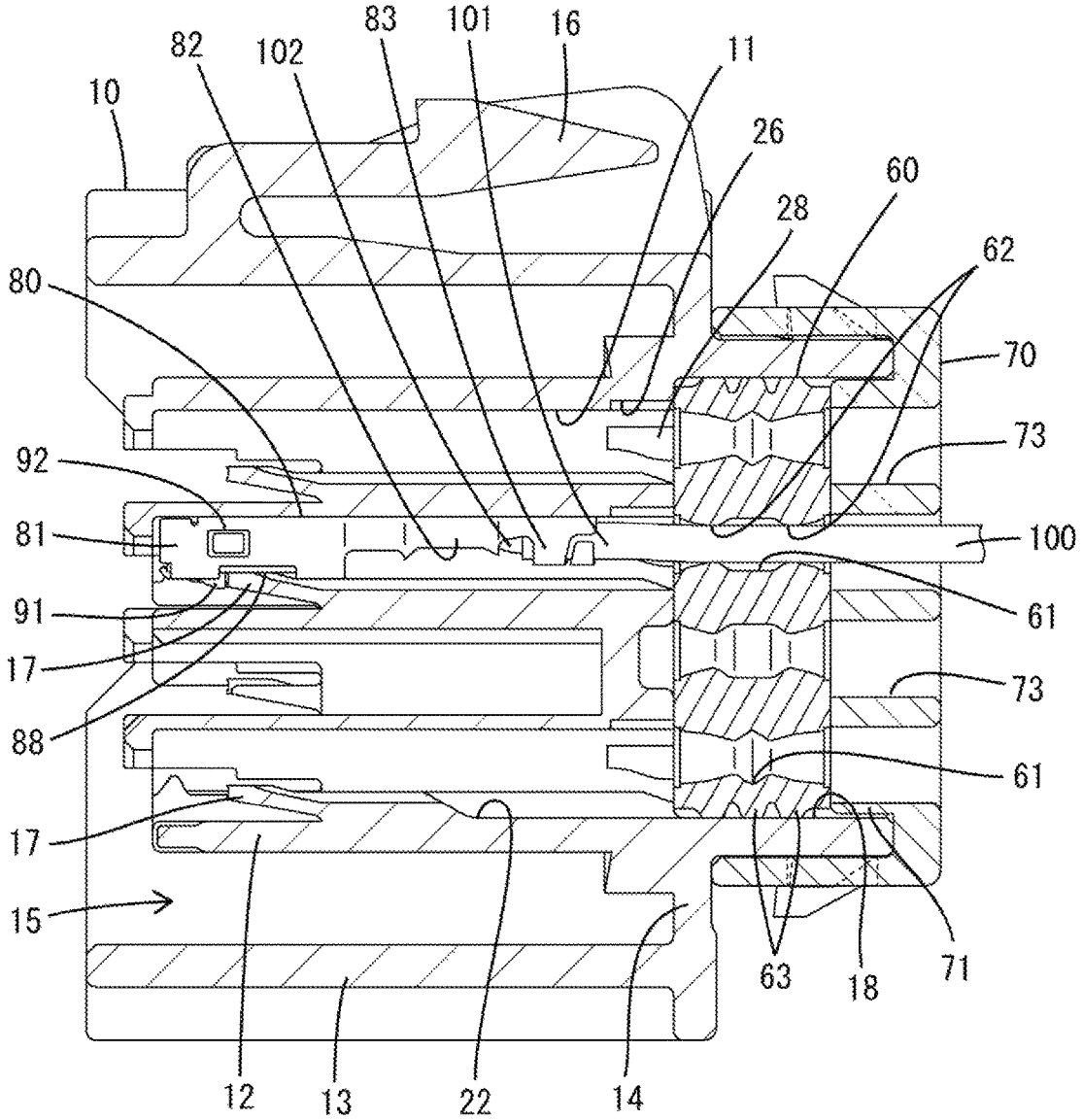
FIG. 8 is a side view in section of the connector.

A first embodiment is described with reference to FIGS. 1 to 11. A connector according to the first embodiment is a waterproof connector and includes, as shown in FIG. 8, a housing 10, a rubber plug 60, a rear holder 70 and terminal fittings 80. A connector body is constituted by the housing 10, the rubber plug 60 and the rear holder 70 excluding the terminal fittings 80. The housing 10 is connectable to an unillustrated mating connector. Note that, in the following description, a surface facing the mating connector at the start of connection of the housing 10 is referred to as a front side concerning a front-rear direction. A vertical direction is based on each figure.

The terminal fitting 80 is formed integrally, such as by bending a conductive metal plate stamped into a predetermined shape. The terminal fitting 80 is long and narrow in the front-rear direction and includes a body 81, a wire barrel 82 located behind the body 81 and an insulation barrel 83 located behind the wire barrel 82. The insulation barrel 83 and the wire barrel 82 are open barrels that can be crimped and connected to a coating part 101 on an end part of a wire 100 and a core part 102 exposed by removing the coating part 101.

Figure 5:
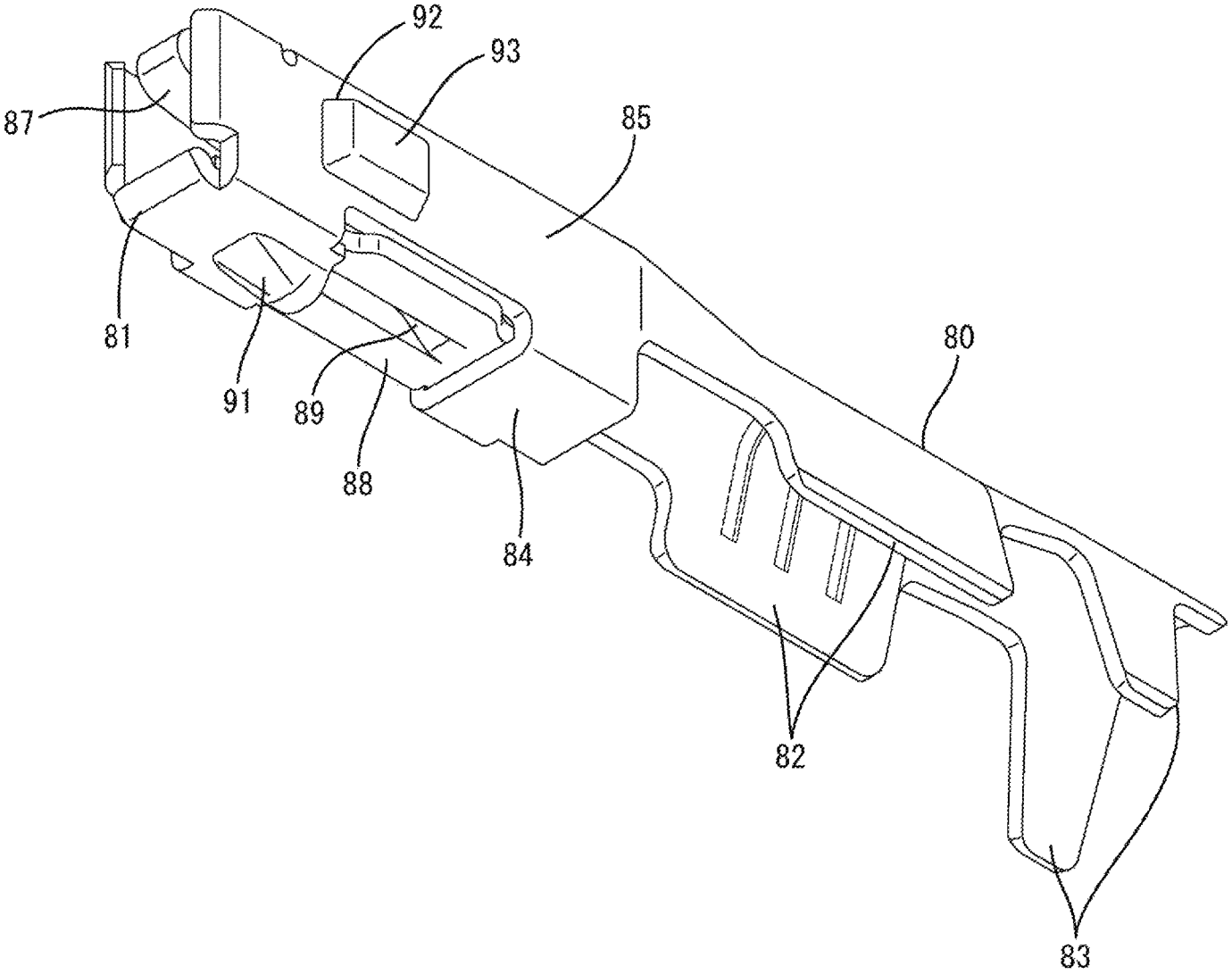
FIG. 5 is a perspective view of a terminal fitting.
Figure 6:
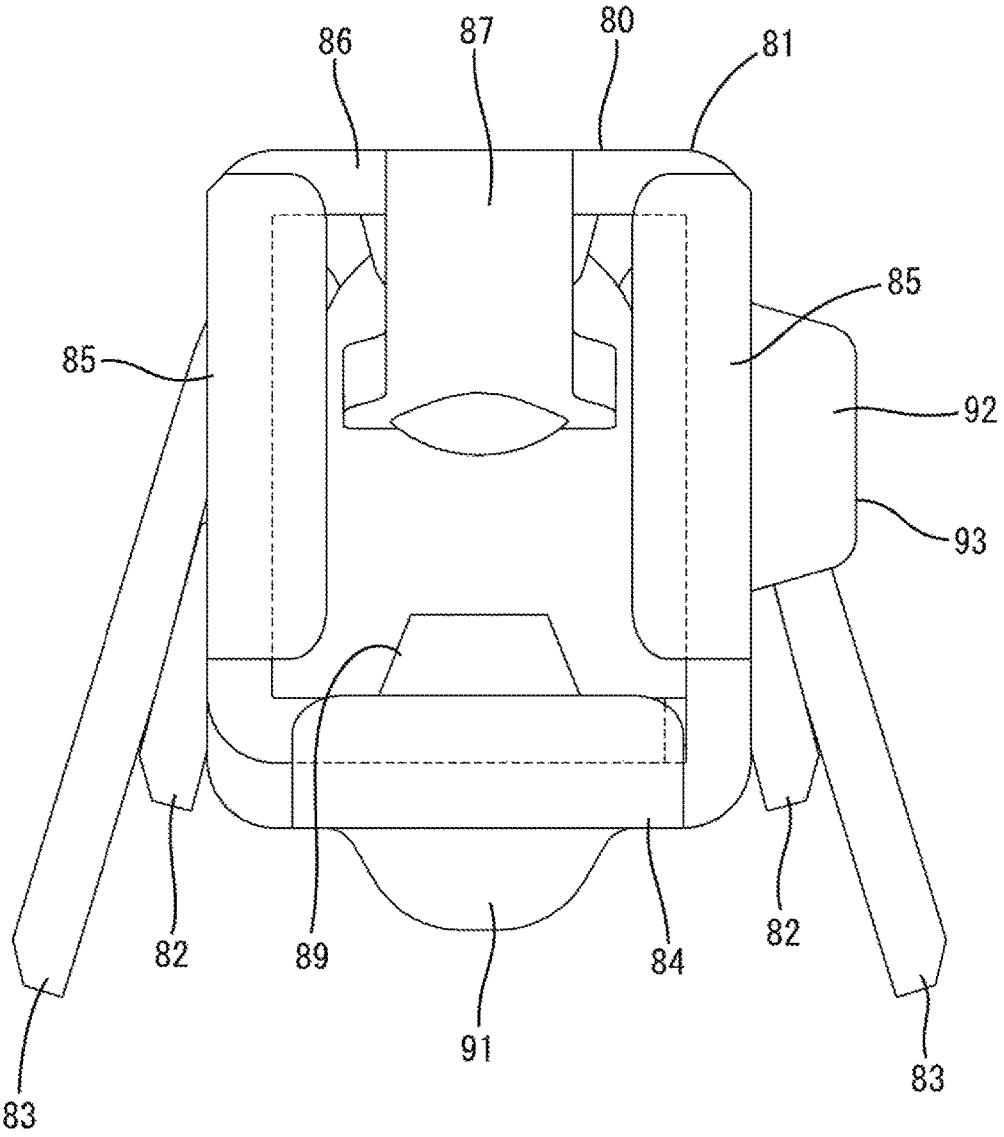
FIG. 6 is a front view of the terminal fitting.

The body 81 is a rectangular tube, as shown in FIG. 5, and includes a bottom wall 84, two side plates 85 and a ceiling plate 86, as shown in FIG. 6. Further, the body 81 includes a deflectable resilient contact piece 87 formed from a tongue that projects from the ceiling plate 86 and that is folded rearward on an inner side of the body 81.

The bottom wall 84 is formed by inner and outer (upper and lower) plates overlapping each other and includes a recess 88 formed by cutting an outer plate part in an intermediate region in the front-rear direction, as shown in FIG. 5. The bottom wall 84 includes an extending portion 89 extending in the front-rear direction while recessing an inner plate part of the recessed portion 88 into the body 81. As shown in FIG. 6, the extending portion 89 faces the resilient contact piece 87 and a male tab of an unillustrated mating terminal fitting is inserted between the extending portion 89 and the resilient contact piece 87. The male tab contacts the resilient contact piece 87 and the extending portion 89 to connect the terminal fittings electrically.

Further, as shown in FIG. 5, the bottom wall 84 includes a second projection 91 formed by causing a laterally intermediate region of an end edge defining the front end of the recess 88 to bulge down on the outer plate. As shown in FIG. 6, the second projection 91 has an outer surface shaped to be continuous along a curved surface from a lower part toward both left and right sides in a front view. Further, as shown in FIG. 7, the second projection 91 has a straight front surface inclined toward a rear side, a rear surface arranged along the vertical direction and an upper surface arranged along the front-rear direction in a side view. A tip part of a locking lance 17 to be described later is lockable to the rear surface of the second projection 91. The tip part of the locking lance 17 can enter the recess 88 while facing the rear surface of the second projection 91 (see FIG. 8).

As shown in FIG. 6, the right side plate 85 intersects the bottom wall 84 and includes a projection 92 formed by causing a vertically intermediate part to bulge laterally. The projection 92 has a flat trapezoidal shape and has a projecting end surface 93 flat in the vertical and lateral directions. However, the front and rear surfaces and the upper and lower surfaces of the projection 92 are inclined and connected to the projecting end surface 93 to form a tapered shape (see FIG. 5). Four corner parts of the projection 92 in a side view are rounded. As shown in FIG. 7, the projection 92 and the second projection 91 partially overlap in the front-rear direction. Specifically, the front surface of the projection 92 is at a position corresponding to an intermediate position of the inclined front surface of the second projection 91 and the rear surface of the projection 92 is located behind the rear surface of the second projection 91.

Figure 1:
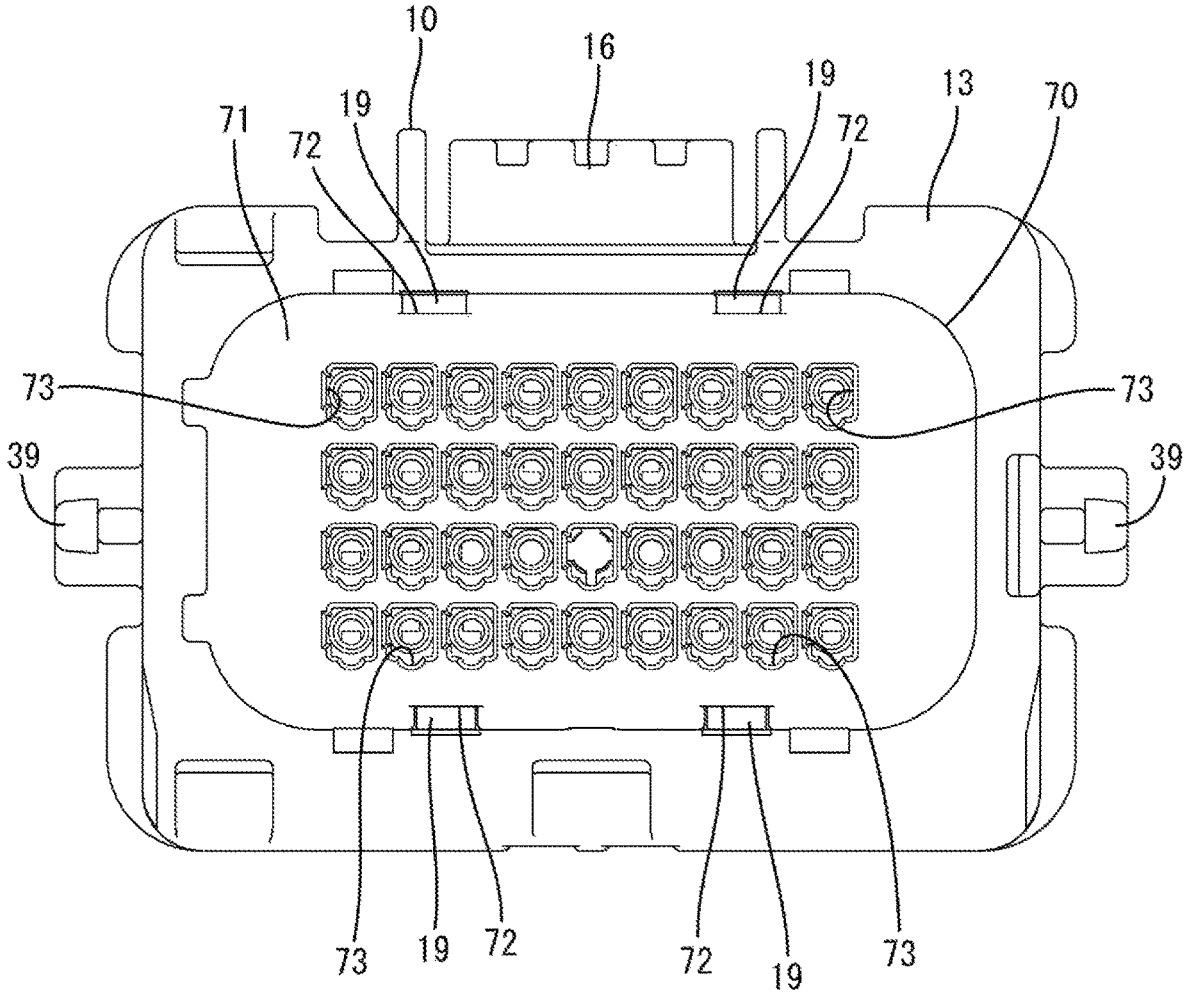
FIG. 1 is a rear view of a connector according to a first embodiment of the invention.
Figure 2:
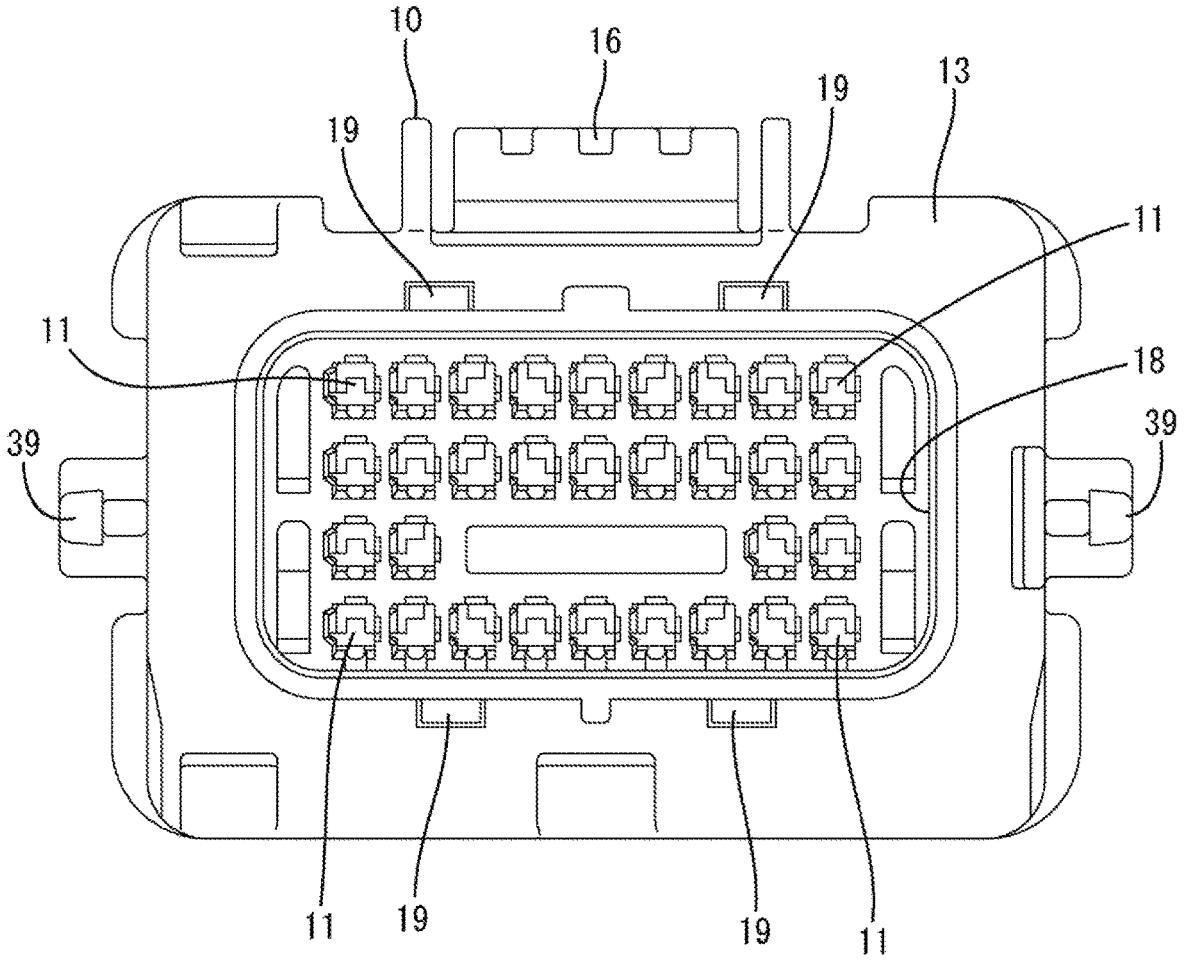
FIG. 2 is a rear view of a housing.
Figure 4:
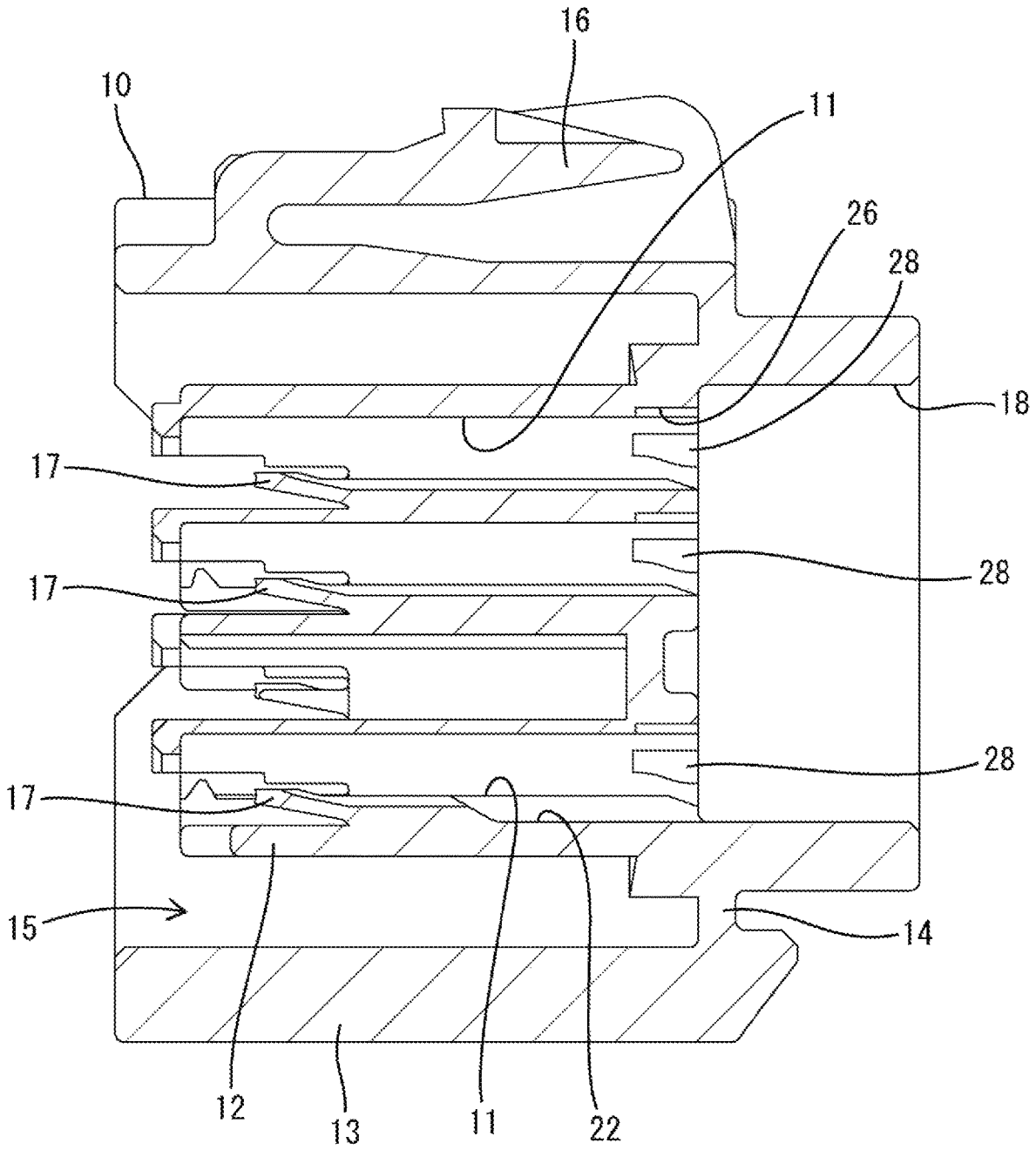
FIG. 4 is a side view in section of the housing.

The housing 10 is made of synthetic resin and includes, as shown in FIG. 4, a housing body 12 having cavities 11 penetrating in the front-rear direction. A fitting tube 13 surrounding the outer periphery of the housing body 12 and a coupling 14 couples the fitting tube 13 and the housing body 12. A space between the fitting tube 13 and the housing body 12 and in front of the coupling 14 is open as a connection space 15 into which a receptacle of the unillustrated mating connector is to be fit. A lock arm 16 projects on the upper surface of the fitting tube 13. The lock arm 16 functions to hold the connectors in a connected state by locking the receptacle of the mating connector. As shown in FIGS. 1 and 2, two support shafts 39 project on both side surfaces of the fitting tube 13 and can supporting an unillustrated lever for advancing the connection of the connectors.

As shown in FIG. 4, the housing body 12 includes locking lances 17 cantilevered obliquely forward on lower surfaces of inner walls of the respective cavities 11. The housing body 12 includes a rubber plug accommodating portion 18 in a rear part. As shown in FIG. 8, the rubber plug accommodating portion 18 is open rearward and the rubber plug 60 is accommodated inside. The rear end of each cavity 11 is open in a back part of the rubber plug accommodating portion 18, which is also the rear surface of the housing body 12. As shown in FIG. 2, the cavities 11 are aligned and arranged in the vertical and lateral directions.

The rubber plug 60 is made of rubber, such as silicon rubber, and is configured as a one-piece rubber plug including sealing holes 61, as shown in FIG. 8. The rubber plug 60 includes inner peripheral lips 62 arranged in the front-rear direction on the inner peripheral surface of each sealing hole 61 and outer peripheral lips 63 arranged in the front-rear direction on the outer peripheral surface thereof. The wires 100 connected to the terminal fittings 80 are inserted respectively into the sealing holes 61 of the rubber plug 60. The inner peripheral lips 62 are held resiliently in close contact with the outer peripheral surface of the coating part 101 of the wire 100, thereby sealing between the rubber plug 60 and the wire 100 in a liquid-tight manner. The outer peripheral lips 63 are held resiliently in close contact with the inner peripheral surface of the rubber plug accommodating portion 18, thereby sealing between the rubber plug 60 and the housing 10 in a liquid-tight manner.

The rear holder 70 is made of synthetic resin and includes, as shown in FIG. 1, a holder body 71 and holder locks 72 provided at intervals on the outer periphery of the holder body 71. As shown in FIG. 8, a front part of the holder body 71 is inserted into the rubber plug accommodating portion 18 and is arranged to sandwich the rubber plug 60 in the front-rear direction between the back surface part of the rubber plug accommodating portion 18 and the holder body 71.

Through holes 73 penetrate the holder body 71 in the front-rear direction. Each through hole 73 has an opening one size larger than those of each sealing hole 61 and each cavity 11 in the vertical and lateral directions. As shown in FIG. 1, each through hole 73 has a substantially rectangular shape (partly with recessed parts for allowing the projection 92 and the second projection 91 to escape) corresponding to the outer shape of the body 81 in a back view. The rear holder 70 is fixed to the housing 10 by each holder lock 72 being locked to a corresponding housing lock 19. Note that a terminal insertion hole is constituted by the through hole 73, the sealing hole 61 and the cavity 11.

Figure 3:
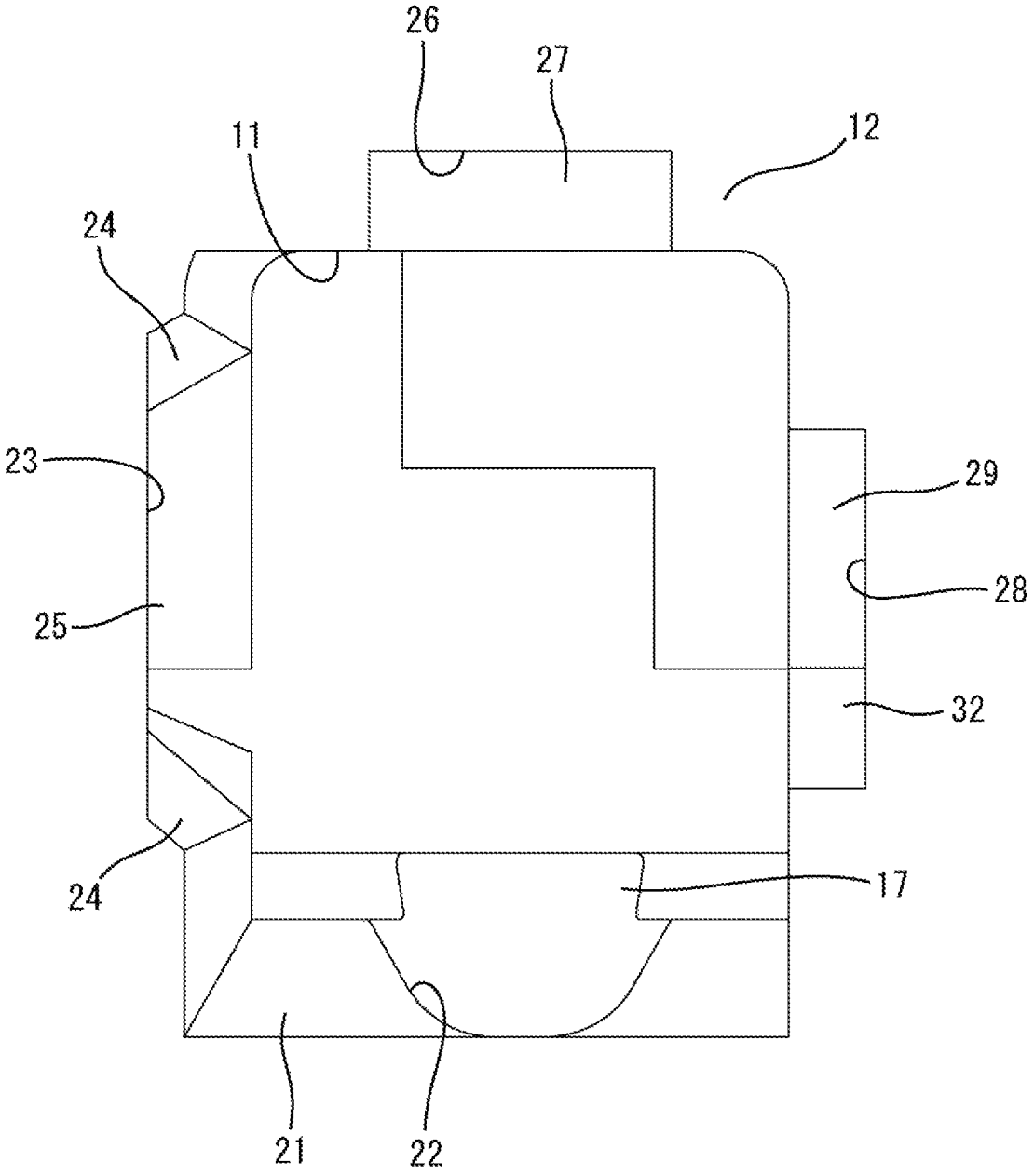
FIG. 3 is an enlarged view of an opening part of a cavity in FIG. 2.

Next, a peripheral structure of each cavity 11 in a rear part of the housing body 12 is described. As shown in FIG. 3, each cavity 11 (only one is shown in FIG. 3) has a substantially rectangular opening in the rear surface of the housing body 12. The housing body 12 includes a chamfered guide 21 in a range from a lower side to a left side of an opening edge part of the cavity 11 in the rear surface thereof.

The rear part of the housing body 12 includes recess-shaped second guiding grooves 22 extending in the front-rear direction while communicating with the cavities 11 in laterally intermediate regions of lower surfaces (also surfaces of separation wall parts between vertically adjacent cavities 11) of the cavities 11. The second guiding groove 22 has a curved cross-section corresponding to the outer shape of the second projection 91 and the rear end thereof is open as a cutout in the guiding portion 21. A front side of the second guiding groove 22 is continuous with a base end part of the locking lance 17 (see FIG. 4).

As shown in FIG. 3, the housing body 12 includes recess-shaped guiding grooves 23 extending in the front-rear direction while communicating with the cavities 11 in vertically intermediate regions of left surface parts (also surfaces of separation wall parts between laterally adjacent cavities 11) of the cavities 11. The guiding groove 23 has a flat trapezoidal cross-section corresponding to the outer shape of the projection 92 and the rear end thereof is open as a cutout in the guiding portion 21. The guiding portion 21 includes two tapered surfaces 24 defining upper and lower ends of the guiding groove 23 in a left side part. The front end of the guiding groove 23 is located on a front side of the housing body 12 and serves as a closing surface 25 extending along the vertical direction.

As shown in FIGS. 3 and 4, the rear part of the housing body 12 includes recesses 26 extending in the front-rear direction while communicating with the cavities 11 in laterally intermediate regions of upper surfaces (also other surfaces of the separation wall parts between vertically adjacent cavities 11) of the cavities 11. That is, the recess 26 is located on an upper side opposite to a lower side where the second guiding groove 22 is located. Each recess 26 has a rectangular opening shape long in the lateral direction, and the rear end thereof is open in the rear surface of the housing body 12. The front surface of the recess 26 is arranged along the vertical and lateral directions at a position near the rear surface of the housing body 12. The upper surface of the recess 26 is arranged along the front-rear and lateral directions. The front and upper surfaces of the recess 26 are formed as contact stop surfaces 27 with which the second projection 91 can be stopped in contact when the body portion 81 is in an inverted insertion posture (see FIG. 11(B)). Note that the recess 26 has the same cross-sectional shape over the entire length in the front-rear direction.

As shown in FIGS. 3 and 4, the rear part of the housing body 12 includes recess-shaped inverted insertion guiding grooves 28 extending in the front-rear direction while communicating with the cavities 11 in vertically intermediate regions of right surface parts (also other surfaces of the separation wall parts between laterally adjacent cavities 11) of the cavities 11. That is, the inverted insertion guiding groove 28 is located on a right side opposite to a left side where the guiding groove 23 is located, and on the right surface part intersecting the lower surface part and upper surface part where the second guiding groove 22 and the recess 26 are located.

Figure 10A:
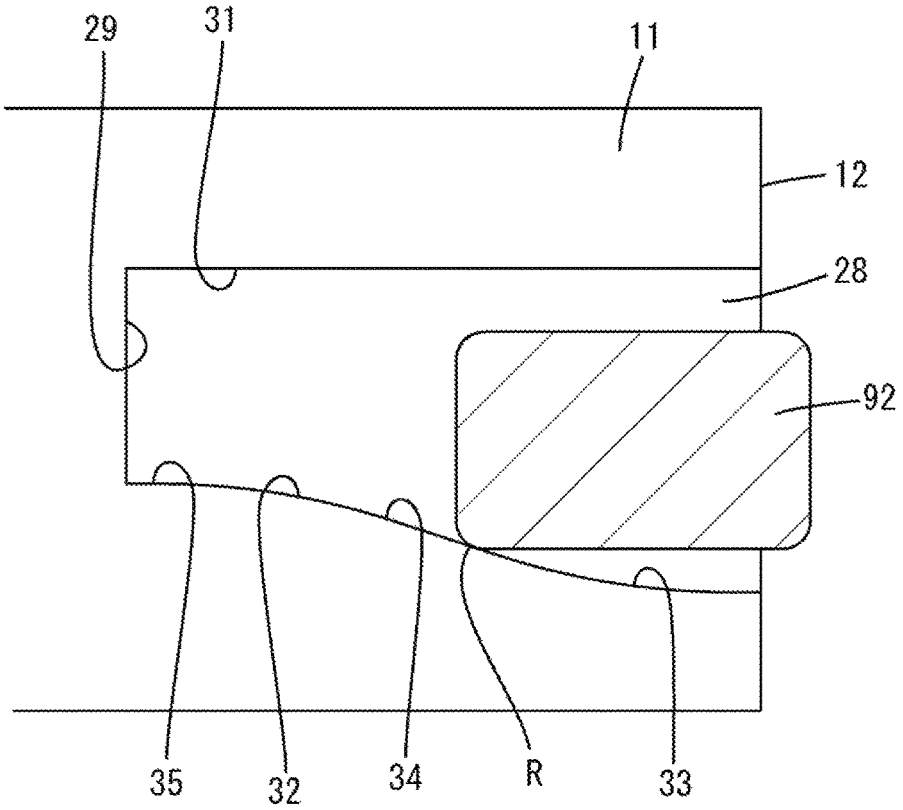
FIG. 10(A) is an enlarged view showing a state where the terminal body is in the inverted insertion posture and a projection is sliding on an inverted insertion guiding slope and FIG. 10(B) is an enlarged view showing a state where a second projection partially enters a recess when in the state of FIG. 10(A).
Figure 10B:
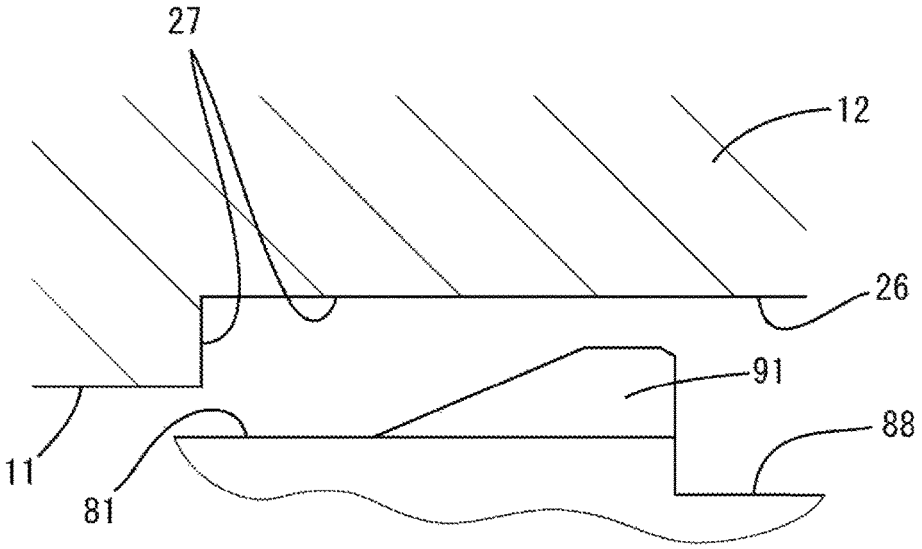
Figure 11:
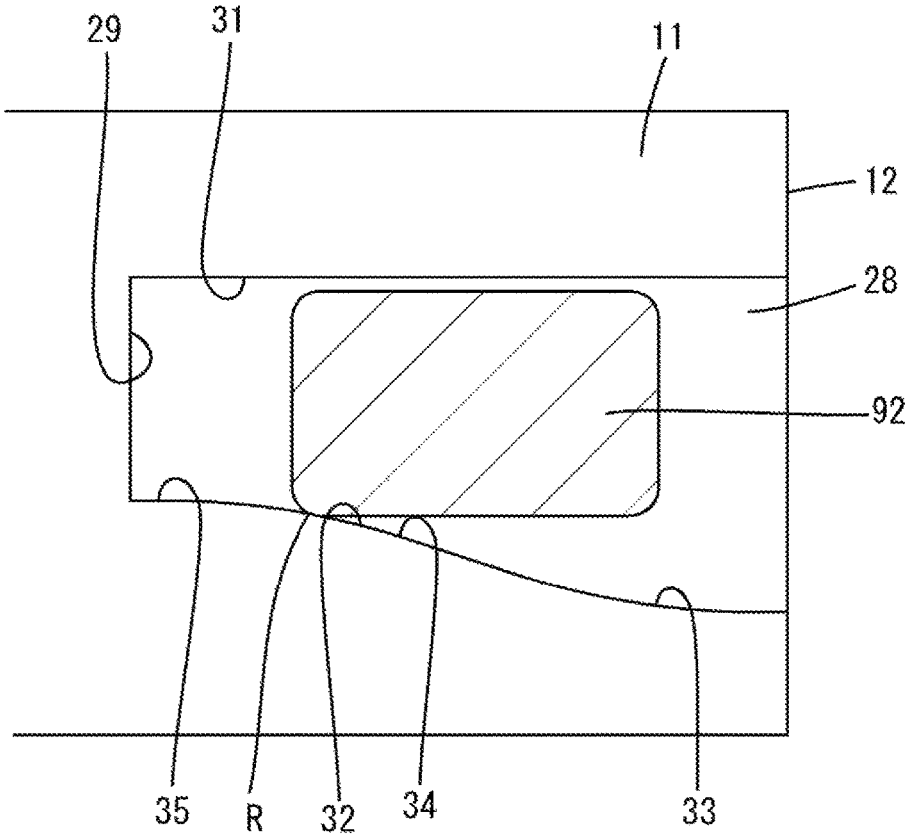
FIG. 11(A) is an enlarged view showing a state where the terminal body is in the inverted insertion posture and the projection is located at an intermediate position of the inverted insertion guiding slope and FIG. 11(B) is an enlarged view showing a state where the second projection is arranged to contact stop surfaces of the recess to stop the terminal fitting when in the state of FIG. 11(A).
Figure 11:
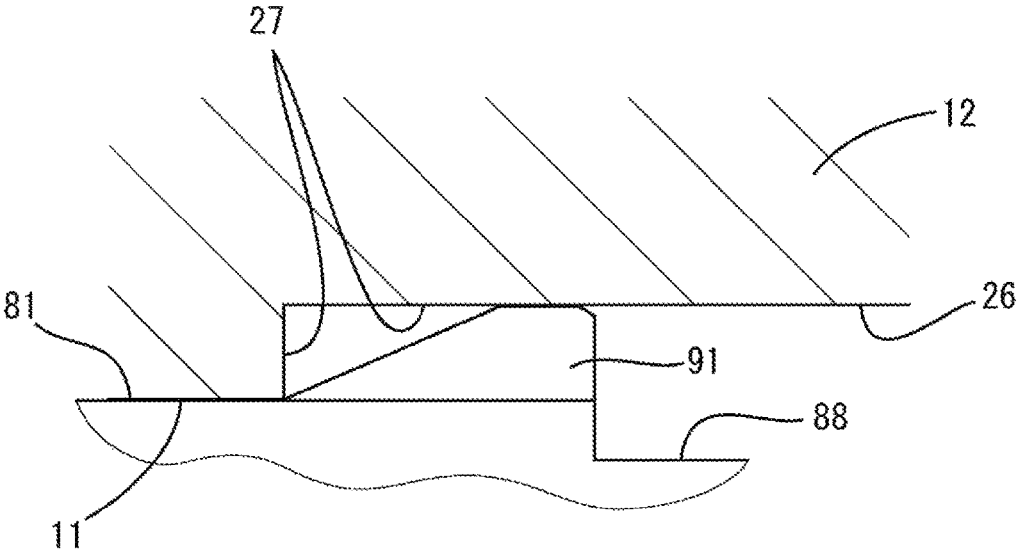

The inverted insertion guiding groove 28 has a rectangular opening shape long in the vertical direction, and the rear end thereof is open in the rear surface of the housing body 12. As shown in FIGS. 10(A) and 11(A), the inverted insertion guiding groove 28 has a shape narrowed to make a vertical width gradually smaller from the rear end toward a front side. The front end surface of the inverted insertion guiding groove 28 is formed into a back surface 29 arranged along the vertical direction. The back surface 29 of the inverted insertion guiding groove 28 and the front surface of the recess 26 are arranged substantially at the same position in the front-rear direction.

The upper end of the inverted insertion guiding groove 28 is a straight surface 31 extending straight in the front-rear direction over the entire length. The lower end surface of the inverted insertion guiding groove 28 is an inverted insertion guiding slope 32 gradually inclined up to approach the straight surface 31 toward a front side (inserting direction of the terminal fitting 80 into the cavity 11). That is, the inverted insertion guiding slope 32 is inclined in a direction intersecting the front-rear direction and is arranged at a position facing the projection 92 having entered the inverted insertion guiding groove 28 when the body 81 is in the inverted insertion posture.

Figure 9:
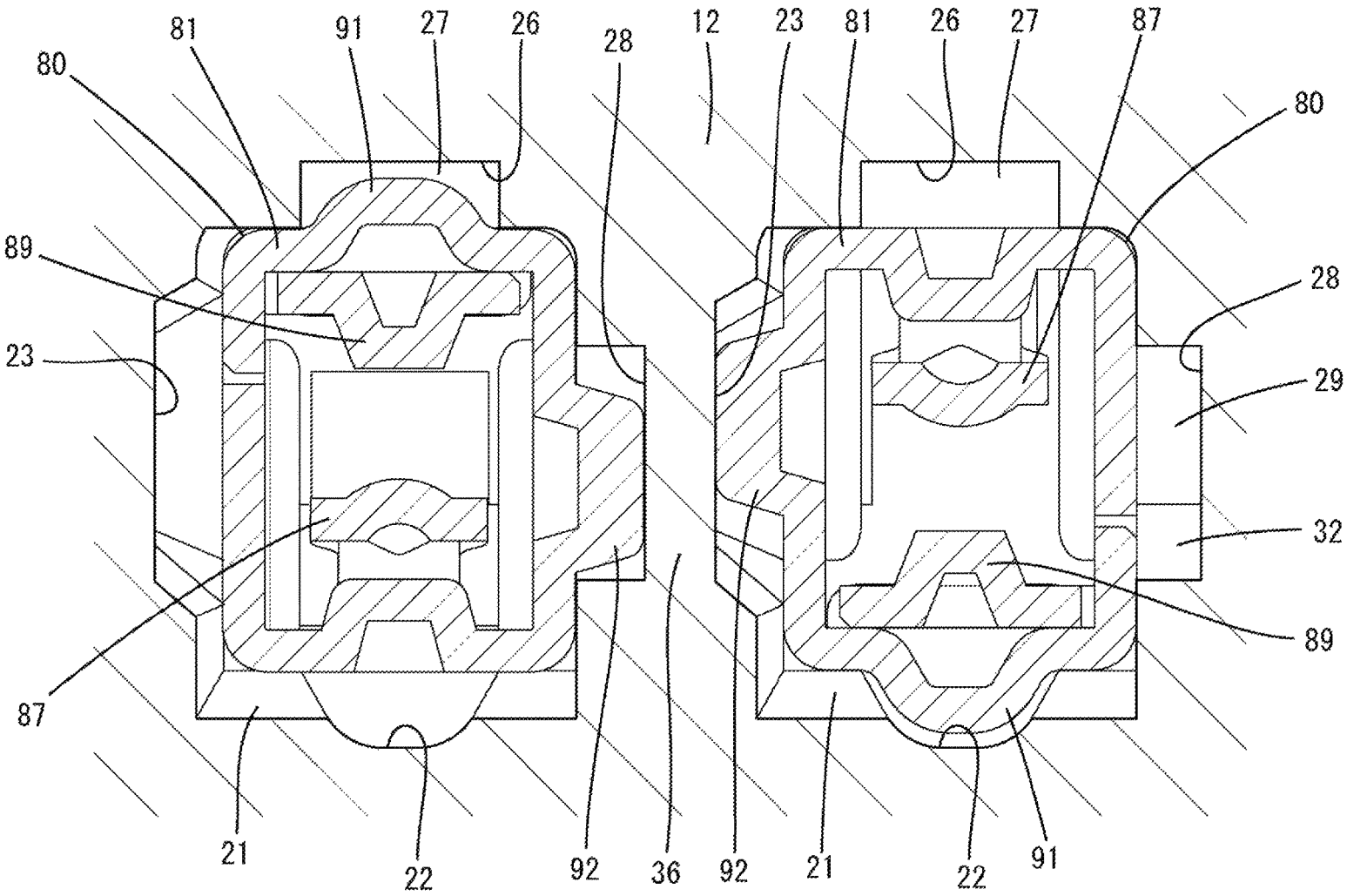
FIG. 9 is a back view in section showing a state where a terminal body is being inserted in a proper insertion posture into a cavity (left side) and a state where a terminal fitting is being inserted in an inverted insertion posture into a cavity (right side).

As shown in FIGS. 10(A) and 11(A), the inverted insertion guiding slope 32 is composed of a rear curved region 33 having an angle of inclination (angle of inclination with respect to the front-rear direction) made gradually steeper from the rear end where the inverted insertion guiding slope 32 is substantially horizontal toward the front side, an intermediate straight region 34 continuous substantially at a fixed angle of inclination from the rear curved region 33 toward the front side, and a front curved region 35 having an angle of inclination made gradually gentler from the intermediate straight region 34 toward the back surface 29 and having a front end substantially horizontally connected to the back surface 29. As shown in FIG. 9, a depth (lateral dimension) of the inverted insertion guiding groove 28 corresponds to a projecting dimension of the projection 92 and is equal to or a slightly smaller than a depth of the guiding groove 23. Note that, as shown in FIG. 9, the inverted insertion guiding groove 28 communicating with the left cavity 11 and the guiding groove 23 communicating with the right cavity 11 are arranged laterally adjacent via a separation wall 36. Thus, the depth of the inverted insertion guiding groove 28 is suppressed to be small to such an extent that the strength of the separation wall 36 is not reduced.

Next, functions and effects of the connector according to the first embodiment are described.

In assembling, the rubber plug 60 and the holder body 71 of the rear holder 70 are inserted successively into the rubber plug accommodating portion 18 of the housing body 12 from behind. The rear holder 70 is fixed to the housing 10 via the holder locks 72, thereby restricting the rearward escape of the rubber plug 60 from the rubber plug accommodating portion 18. Further, by assembling the rubber plug 60 and the rear holder 70 with the housing 10, the respective cavities 11, the respective sealing holes 61 and the respective through holes 73 are arranged to communicate coaxially in the front-rear direction (FIG. 8).

In the above state, each terminal fitting 80 is inserted into each cavity 11. At this time, the terminal fitting 80 is inserted into the corresponding cavity 11 through the sealing hole 61 of the rubber plug 60 from the through hole 73 of the rear holder 70. If the body 81 is in a proper insertion posture, the projection 92 and the second projection 91 are allowed to escape into the recessed parts of the through hole 73, pass through the sealing hole 61 while deflecting the inner peripheral lips 62 and further are aligned to enter the guiding groove 23 and the second guiding groove 22 of the housing body 12 (see right terminal fitting 80 of FIG. 9). In the process of inserting the body 81 into the cavity 11, the second projection 91 interferes with the locking lance 17 to deflect and deform the locking lance 17.

When the body 81 is inserted properly into the cavity 11, the locking lance 17 resiliently returns and the second projection 91 is retained and locked by the locking lance 17. Further, the projection 92 is arranged in proximity to the closing surface 25 of the guiding groove 23. In this way, as shown in FIG. 8, the body 81 (terminal fitting 80) in the proper insertion posture is inserted into the cavity 11 substantially without being stopped on the way.

In contrast, if the body 81 is in a vertically inverted insertion posture, the projection 92 and the second projection 91 pass through the through hole 73 having large opening dimensions and pass through the sealing hole 61 while deflecting the inner peripheral lips 62. In the rear surface of the housing body 12, the second projection 91 is facing the recess 26 and is located to face the contact stop surfaces 27. Additionally, the projection 92 is facing the inverted insertion guiding groove 28 and faces the inverted insertion guiding slope 32 (see left terminal fitting 80 of FIG. 9). Further, if the insertion of the terminal fitting 80 into the cavity 11 continues, the projection 92 enters the inverted insertion guiding groove 28 and lower corner parts (rounded corner parts and indicated by R in FIG. 10(A)) of the front surface of the projection 92 contacts the rear curved region 33 of the inverted insertion guiding slope 32 and further slide successively on the intermediate straight region 34 and the front curved region 35 from the rear curved region 33.

The terminal fitting 80 is shifted and/or inclined up toward the front side according to a sliding movement of the projection 92 on the inverted insertion guiding slope 32. Thus, the second projection 91 also is shifted and/or inclined upward to be inserted gradually deeper into the recess 26 (see FIGS. 10(B) and 11(B)). Thereafter, the second projection 91 substantially entirely enters the recess 26 to be stopped in contact with the contact stop surfaces 27 of the recess 26 (see FIG. 11(B)). Further, a peripheral area (surface equivalent to the lower surface of the outer plate of the bottom wall 84 when the body 81 is in the proper insertion posture) of the second projection 91 of the body 81 is in a state capable of contacting the upper surface of the cavity 11. In this way, any further insertion of the terminal fitting 80 in the inverted inserting state is restricted. Thus, a situation where the terminal fitting 80 is inserted in the inverted inserting state into the cavity 11 is avoided. Note that when the second projection 91 is stopped in contact with the contact stop surfaces 27 of the recess 26, the projection 92 is located at an intermediate position of the inverted insertion guiding slope 32, in particular, located on the front curved region 35 of the inverted insertion guiding slope 32 and does not contact the back surface 29 and the straight surface 31 (see FIG. 11(A)).

As described above, in the first embodiment, when the body 81 is in the inverted insertion posture, the projection 92 projecting on the outer surface of the body 81 enters the inverted insertion guiding groove 28 and slides on the inverted insertion guiding slope 32 as the terminal fitting 80 is inserted and, finally, the second projection 91 is stopped in contact with the contact stop surfaces 27 of the recess 26. Thus, the terminal fitting 80 is stopped state, and the terminal fitting 80 in the inverted inserting state can be detected reliably.

The projection 92 is at the intermediate position of the inverted insertion guiding slope 32 when the body 81 is in the inverted insertion posture and the terminal fitting 80 stops. Thus, the projection 92 need not be stopped in contact with the back surface 29 of the inverted insertion guiding groove 28, and a selection range of a means for stopping the terminal fitting 80 can be expanded and a degree of freedom in design can be enhanced.

Furthermore, since the second projection 91 is provided on the outer surface of the body 81, the housing 10 includes the recess 26 communicating with the cavity 11 and configured to receive the second projection 91 and the contact stop surfaces 27, with which the second projection 91 is stopped in contact when the body 81 is in the inverted insertion posture, are provided on the inner surface of the recess 26, the terminal fitting 80 in the inverted inserting state can be stopped more reliably, utilizing the recess 26 having a relatively high degree of freedom.

Second Embodiment

Figure 12:
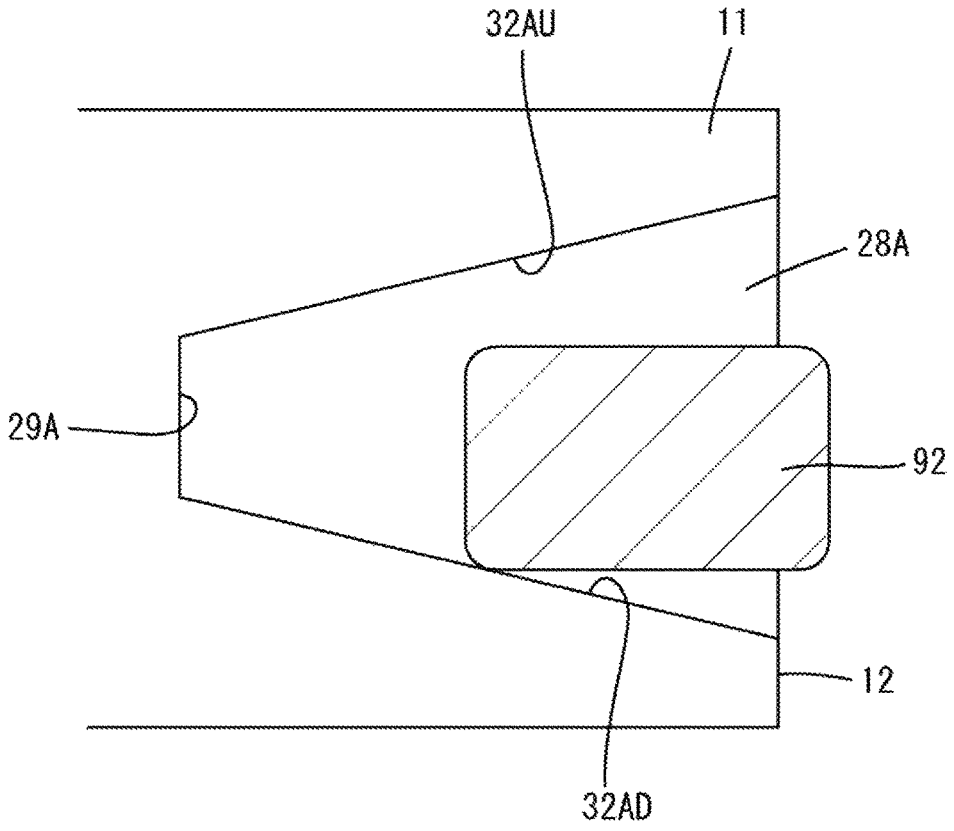
FIG. 12(A) is an enlarged view of a second embodiment showing a state where a terminal body is in an inverted insertion posture and a projection slides on an inverted insertion guiding slope.
FIG. 12(B) is an enlarged view showing a state where the projection is arranged such that any further pushing toward a back side of the inverted insertion guiding slope is restricted.
Figure 12:
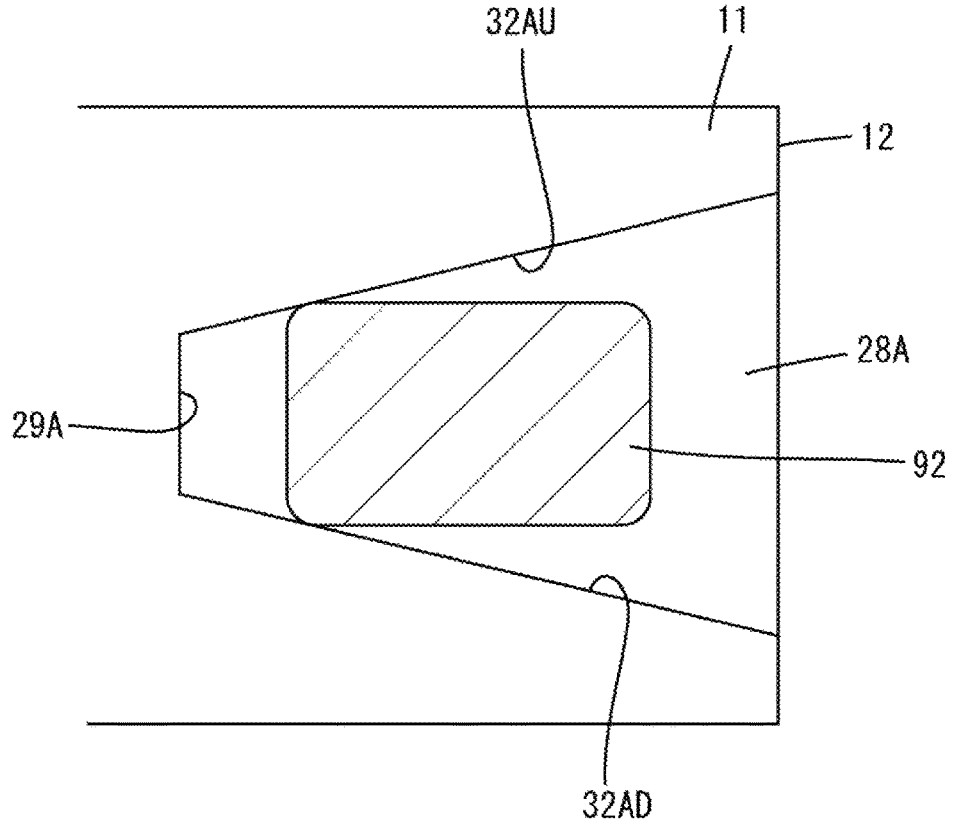

FIG. 12 shows a second embodiment of the invention. In the case of the second embodiment, the form of an inverted insertion guiding groove 28A including inverted insertion guiding slopes 32AD and 32AU is different from that of the first embodiment. Although not shown, the second embodiment also differs from the first embodiment in including no contact stop surface 27 in a recess 26. The other components are similar to those of the first embodiment and repeated description on the similar components is omitted.

The inverted insertion guiding groove 28A is arranged similarly to the inverted insertion guiding groove 28 of the first embodiment. Although not shown, the inverted insertion guiding groove 28A is arranged in a surface part on a side opposite to a guiding groove 23 across a cavity 11 and intersecting a surface part where the recess 26 is located.

The rear end of the inverted insertion guiding groove 28A is open in the rear surface of a housing body 12. The front of the inverted insertion guiding groove 28A is formed into a back surface 29A extending in the vertical direction. A vertical length of the back surface 29A is smaller than a vertical dimension of a projection 92.

The lower surface of the inverted insertion guiding groove 28A is formed into a straight inverted insertion guiding slope 32AD on a lower side inclined up toward a front side and obliquely intersecting and connected to the back surface 29A. The upper surface of the inverted insertion guiding groove 28A is a straight inverted insertion guiding slope 32AU on an upper side inclined down toward the front and obliquely intersecting and connected to the back surface 29A. Thus, the inverted insertion guiding slopes 32AU, 32AD on the upper and lower sides gradually narrow a vertical width toward the front side.

During the insertion of the terminal fitting 80 into the cavity 11, if a body 81 is in an inverted insertion posture, the projection 92 enters the inverted insertion guiding groove 28A and contacts either one of the inverted insertion guiding slopes 32AU, 32AD (inverted insertion guiding slope 32AD on the lower side in a shown case) on the upper and lower sides facing each other in an entering direction (see FIG. 12(A)). If the insertion of the terminal fitting 80 is continued, the projection 92 slides on one inverted insertion guiding slope (inverted insertion guiding slope 32AD on the lower side). Finally, the projection 92 also contacts the other inverted insertion guiding slope (inverted insertion guiding slope 32AU on the upper side) and is sandwiched between the inverted insertion guiding slopes 32AU and 32AD on the upper and lower sides (see FIG. 12(B)). In this way, further insertion of the terminal fitting 80 in the inverted insertion posture is restricted. At this time, there is a clearance between the projection 92 and the back surface 29A of the inverted insertion guiding groove 28A. According to the second embodiment, the terminal fitting 80 in an inverted inserting state can be detected reliably even if the recess 26 is not provided with the contact stop surfaces 27.

Other embodiments are briefly described below.

The inverted insertion guiding grooves and the inverted insertion guiding slopes may be provided in the rear holder. In this case, the rear holder is included in the connector body and the through holes are included in the terminal insertion holes.

The inverted insertion guiding slope of the first embodiment may be entirely inclined straight.

The inverted insertion guiding slope of the second embodiment may be inclined in a curved manner.

The front surface of the second projection may be upright in the vertical direction perpendicular to the inserting direction of the terminal fitting.

The terminal fitting in the inverted inserting state may be stopped by the contact of the projection with the back surface of the inverted insertion guiding groove.

The connector may be a non-waterproof connector including no rubber plug and no rear holder in a rear part of a housing. Alternatively, the connector may be a connector of an individual waterproof type in which an individual rubber plug is fit on a wire connected to a terminal fitting without including a rubber plug and a rear holder in a rear part of a housing.

LIST OF REFERENCE SIGNS

10 . . . housing (connector body)
11 . . . cavity (terminal insertion hole)
23 . . . guiding groove
26 . . . recess
27 . . . contact stop surface (contact stop portion)
28, 28A . . . inverted insertion guiding groove
32, 32AD, 32AU . . . inverted insertion guiding slope
66 . . . rear holder
80 . . . terminal fitting
81 . . . body
91 . . . second projection
92 . . . projection

What is claimed is:

1. A connector, comprising:

a terminal fitting including a projection on an outer surface of a body; and a connector body including a terminal insertion hole into which the body is to be inserted, and a guiding groove communicating with the terminal insertion hole and configured such that the projection enters the guiding groove;

wherein the connector body includes an inverted insertion guiding groove communicating with the terminal insertion hole and configured such that the projection enters the inverted insertion guiding groove when the body is in an inverted insertion posture, and an inverted insertion guiding slope formed on a groove surface of the inverted insertion guiding groove, inclined in a direction intersecting an inserting direction of the body to face the projection and configured such that the projection slides on the inverted insertion guiding slope.

2. The connector of claim 1, wherein the projection is located at an intermediate position of the inverted insertion guiding slope when the body is in the inverted insertion posture and the terminal fitting stops.

3. The connector of claim 2, wherein:

the terminal fitting includes a second projection on a surface of the body; and the connector body includes a recess communicating with the terminal insertion hole and configured to receive the second projection and a contact stop portion with which the second projection is stopped in contact when the body is in the inverted insertion posture is provided on an inner surface of the recess.

4. The connector of claim 1, wherein:

the terminal fitting includes a second projection on a surface of the body; and the connector body includes a recess communicating with the terminal insertion hole and configured to receive the second projection and a contact stop portion with which the second projection is stopped in contact when the body is in the inverted insertion posture is provided on an inner surface of the recess.

* * * * *